US005106660A

United States Patent [19]

Vorel

[11] Patent Number: 5,106,660

[45] Date of Patent: Apr. 21, 1992

[54] DECORATIVE WALL PANEL

[76] Inventor: Mark S. Vorel, 4410 Venneman Ct. SE., Grand Rapids, Mich. 49512

[21] Appl. No.: 459,938

[22] Filed: Jan. 2, 1990

[51] Int. Cl.[5] ..... A47G 1/12; G09F 19/00

[52] U.S. Cl. ..... 428/13; 428/14; 428/34; 428/542.2; 52/171; 52/304; 52/788; 40/406; 40/412; 40/422; 40/446; 40/477; 40/577

[58] Field of Search ..... 428/13, 14, 213, 34, 428/542.2, 192; 52/788, 790, 171, 304, 202, 203; 156/107, 104; 40/406, 577, 446, 422, 412, 477, 407, 409; 350/267, 312

[56] References Cited

U.S. PATENT DOCUMENTS 4,044,519 8/1977 Morin et al. ..... 52/171
4,093,352 6/1978 Pisar ..... 52/171
4,380,994 4/1983 Seemann ..... 52/171
4,469,726 9/1984 Niinivuo ..... 428/13
4,686,784 8/1987 Smithies ..... 428/13
4,768,315 9/1988 Grimme ..... 52/171

*Primary Examiner*—Ellis P. Robinson
*Assistant Examiner*—Donald J. Loney

[57] ABSTRACT

A decorative display panel is formed by spaced transparent panes defining a space containing preferably water. A porous tube at the bottom of the space is supplied preferably with air under pressure to generate a curtain of bubbles moving upward in the water. The assembly is illuminated by edge lighting. The unit can be either free-standing, or incorporated in a partition system.

12 Claims, 2 Drawing Sheets

DECORATIVE WALL PANEL

BACKGROUND OF THE INVENTION

The design of decorative displays often incorporates the principle that movement attracts the eye. This is particularly true when the motion is random in the sense that it is not precisely repeated. The movement of bubbles upward through the water in a small aquarium has hypnotic fascination almost equal to that of watching the fish.

Displays have also incorporated scenic material of various types mounted behind transparent panes, and also between transparent panes so as to be visible from opposite sides. They have been designed either as wall-mounted, or as free-standing units. Some have included flowing water as another form of eye-catching random motion. Scenic material has also been applied to walls and movable partitions, ranging from extensive murals to small-scale patterns. Occasionally, such material has been applied to a transparent panel for either-side viewing. The present invention touches on all of these principles to provide a practical and attractive structure.

SUMMARY OF THE INVENTION

This invention provides a display panel that can be incorporated into a partition section, free standing or wall hanging unit, or used as a window. Spaced transparent panes define a space that contains fluids of different densities. The preferred combination of fluids is water and air. A porous diffuser tube at the bottom of the space is supplied with air, or a lighter substance than water, under controllable pressure to generate a curtain of bubbles moving upward through the water. Preferably, a light source below the edges of the fluid envelope provides edge lighting that illuminates the moving bubbles The density of the bubbles can be increased to the point that the panel assembly becomes a translucent screen. Air is supplied to the porous tube via a conduit entering the space at the top, and is exhausted also at the top.

DESCRIPTION OF THE PREFERRED EMBODIMENT

Figure 1:
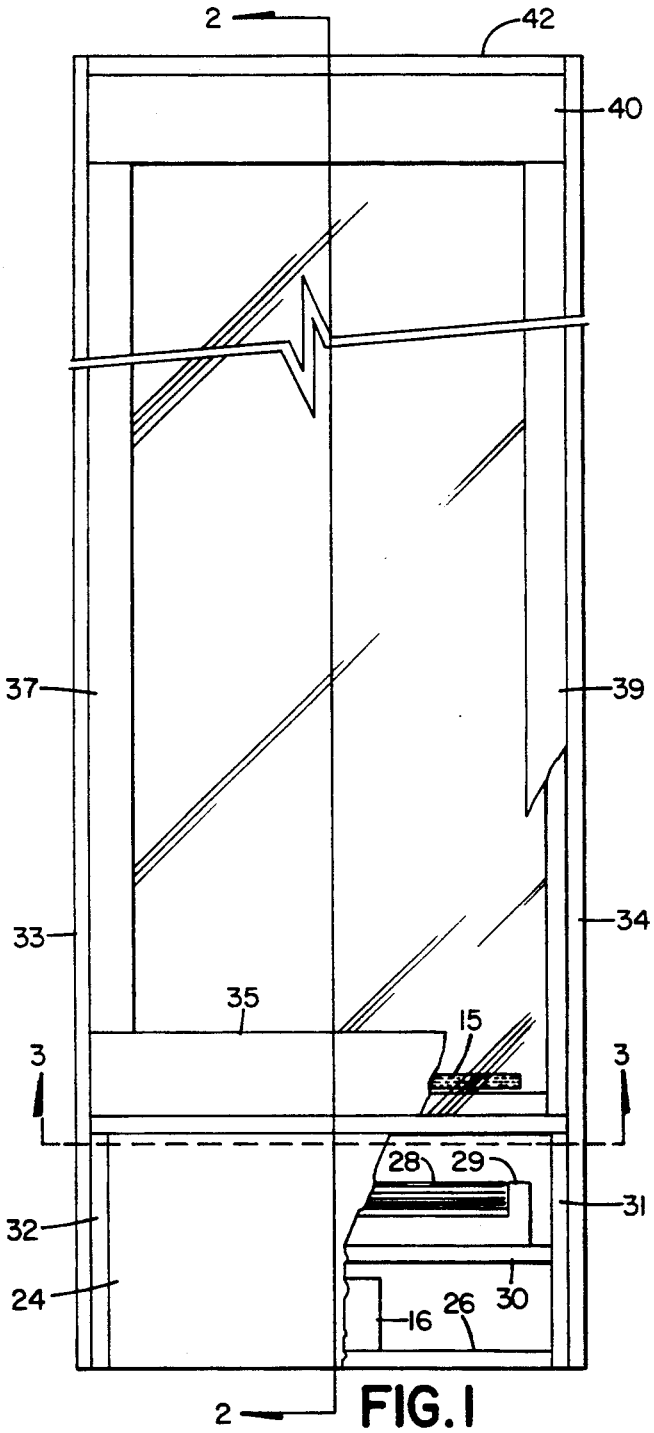
FIG. 1 presents a front elevation of a panel assembly incorporating the present invention.
Figure 2:
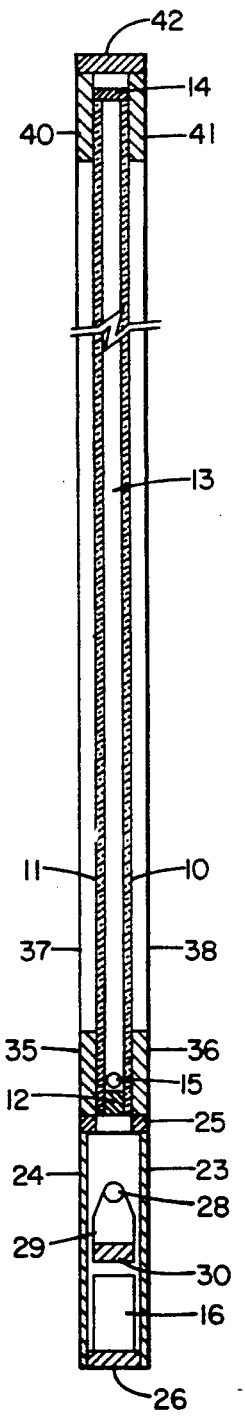
FIG. 2 is a section on the plane 2—2 of FIG. 1.
Figure 3:
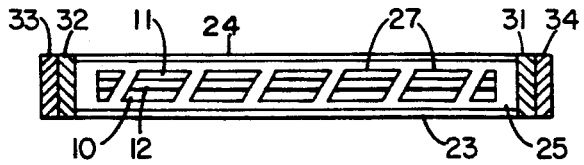
FIG. 3 is a section on the plane 3—3 of FIG. 1.

Referring to the drawings, particularly to FIG. 2, the transparent panes 10 and 11 are separated by a spacer strip 12. This envelope may be produced in several ways, one of which is by forming a one piece glass or plastic bottle similar in construction to some THERMOPANE windows, or in multiple piece construction as detailed here by bonding materials together. If desired, the bonding may be supplemented by a coating of a sealing compound such as a silicone-base material applied around the closed edges on the inside. The space between the two panes established by the spacer is preferably on the order of a half and inch. The top of the space 13 between the panes may be closed off by a cap strip 14, which may be sealed or un-sealed according to preference. Usually, water will be inserted in the space 13 to a level adjacent the top of the space, leaving room for the accumulation of air.

Figure 4:
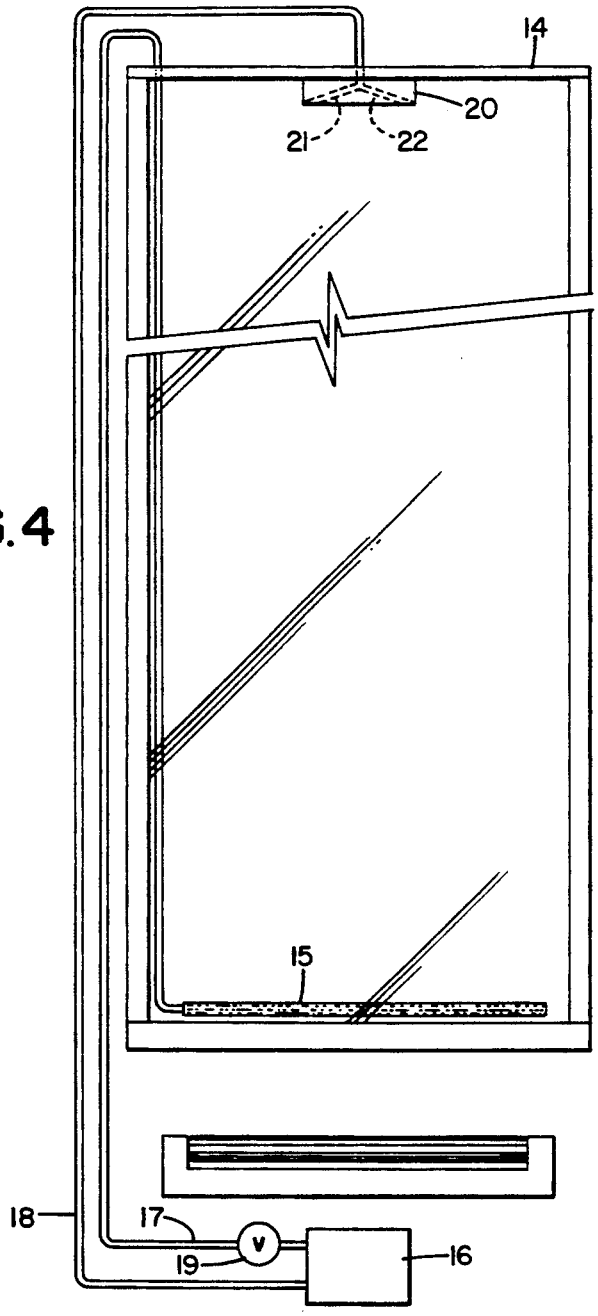
FIG. 4 is a circuit diagram showing the air-supply system.

Along the bottom edge of the space 13, the porous diffuser tube 15 is installed. It may be maintained in position either through gravity alone, or possibly secured by engaging some of a sealing compound (not shown) previously inserted along the lower edge. Referring to the schematic circuit diagram of FIG. 4, a pump 16 supplies pressure to the diffuser tube 15 through the conduit 17, which enters the space 13 at the top of the assembly. Air, or some fluid lighter than the fluid between the panes (and which does not dissolve in it), is exhausted from the space above the level of the water (not shown) through the return line 18. The quantity of the air delivered to the diffuser tube is controlled by the adjustable valve 19. The return line 18 terminates in the block 20 bonded to the cap 14. The block is provided with the lateral passages 21 and 22, which communicate with the return line 18. Normally, the liquid level in the space 13 will be below the bottom of the block 20. The bubbles are thus provided with a collecting space from which the air can be withdrawn and returned to the pump.

Along the bottom edge of the assembly, a base structure is provided by the side panels 23 and 24, the top plank 25, and the bottom plank 26. These components may be of wood, plywood, or practically any convenient material. Normally they will be bonded together. When edge lighting is used, the top plank 25 is perforated with a series of openings as shown at 27, which extend laterally sufficiently to expose the lower edges of the panes 10 and 11, along with the spacer 12. This exposure permits light from the fluorescent tube 28 to be projected upward into the transparent components for the effect known as "edge lighting". This light illuminates the curtain of bubbles moving upward through the water within the space between the panes. The light bulb 28 is mounted in the standard fixture 29 supported on the bridge member 30 secured at its opposite ends to the end pieces 31 and 32 of the base.

Figure 6:
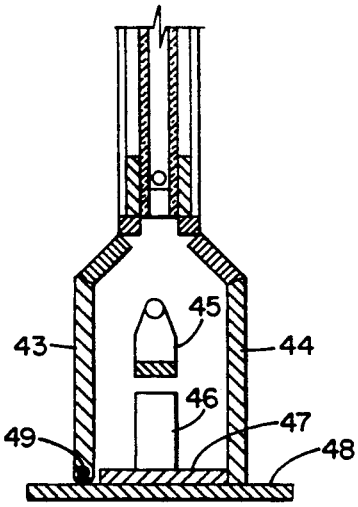
FIG. 6 shows a modified construction for the base of the assembly.

A frame preferably surrounds the entire structure, and is formed by the outer side members 33 and 34, the peripheral plates 35–41, and the top closure strip 42. The peripheral plates enclose the transparent panes, and extend inward to a sufficient extent to cover the conduits 17 and 18, and also the exhaust area at the top of the space 13. The assembly illustrated in FIG. 2 is appropriate for inclusion in partition sections, or for mounting against some other wall structure. The modification illustrated in FIG. 6 presents a modified base structure more appropriate for a free-standing unit. The side panels 43 and 44 are spaced apart to provide greater stability, and still function as a housing for the light fixture 45 and the pump 46. In all of these views, the wiring associated with the fixture has been omitted for clarity. The base plank 47 may be secured to the floor 48, if desired, or provided with casters. The side panel 43 is shown provided with a dust seal at 49, so that the panel 43 may be either removably secured to the remainder of the base, or hinged for outward movement sufficient to expose the interior of the base housing for adjustment.

Figure 5:
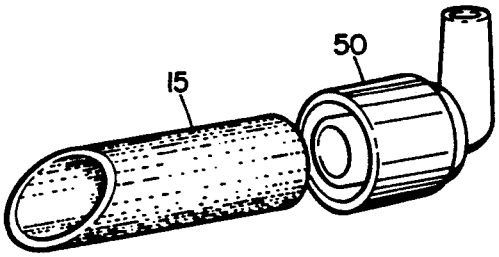
FIG. 5 is a fragmentary view in perspective, on an enlarged scale, showing the porous air diffuser conduit.

It is obvious that the dimensions of the components of the assembly may be varied over a wide range. It is preferable, however, to keep the spacing between the transparent panels to a distance less than twice the diameter of the porous diffuser tube 15. A standard diffuser with an outside diameter of five sixteenths (5/16) of an inch has been selected as preferable for association with a one-half inch spacing between the panes. As shown in FIG. 5, the tube is normally provided with standard fittings as shown at 50 for connection to the air-supply conduit 17.

I claim:

1. A variably transparent decorative panel comprising:

a pair of parallel, upright, closely spaced transparent plates having sealed peripheral edges at least at lower and side edges of the panel so as to provide a planar sealed liquid cavity between the plates;

a layer of liquid substantially filling the planar cavity between the plates;

an elongated diffuser manifold positioned in the cavity between the plates and running along the lower edge of the panel, the diffuser manifold having a plurality of spaced gas outlet openings therein along the lower edge of predetermined pressure forms a sheet of bubbles that rise to the top of the plates;

bubbler pump means external of the plates for pumping gas under pressure into the diffuser manifold between the plates, so as to produce the sheet of gas bubbles; and control means for controlling the actuation of the bubbler pump such that the panel is substantially transparent when the bubbler pump is deactuated and is less transparent or translucent when the bubbler pump is operated.

2. A panel means according to claim 1 and further comprising edge lighting means for directing artificial illumination through the water in an edgewise direction, the illumination reflecting off the bubbles and affecting the visual appearance of the panel when the bubbler pump is operating.

3. A panel according to claim 1, wherein the diffuser manifold comprises a hollow, elongated tube that extends along the lower edge of the panel with outlet openings formed in sides of the tube to permit gas to pass into the water through the tube, the plates being spaced adjacent each side of the tube.

4. A panel according to claim 3, wherein the plates are spaced apart by a distance of up to about twice the width of the tube.

5. A panel according to claim 4, wherein the tube is about 5/16 inches in diameter.

6. A panel according to claim 1, wherein the outlet diffuser manifold is perforated with a sufficiently large number of sufficiently small openings such that the sheet of small bubbles formed by the gas when the bubbler pump is operating renders the panel substantially non-transparent.

7. A panel according to claim 1, wherein the diffuser manifold comprises a hollow elongated tubular member having porous side walls that permit the passage of gas therethrough.

8. A panel according to claim 1, wherein the panel includes a frame around the periphery of the transparent plates that conceals the edges of the plates and the diffuser manifold, the water filling the panel at least where the plates are visible inside the frame.

9. A panel according to claim 1, wherein the pump means is incorporated in the panel and is concealed from view, the panel being sized and shaped in the form of a panel unit that fits into a free standing room partition panel system.

10. A panel according to claim 1, wherein the lighting means is external of the plates and runs along an edge thereof, the edge adjacent the lighting means including a transparent slot that permits light transmission from the lighting means into the water through said edge.

11. A panel according to claim 10, wherein the lighting means is an elongated tubular light housed in a supporting housing positioned below the transparent slot, the lower edge of the slot being sealed with a substantially translucent or transparent sealer so as to transmit light from the light into the water through the sealer.

12. A panel according to claim 1, wherein closely spaced plates comprise separate panes spaced apart in parallel relationship by peripheral spacers.

* * * * *

UNITED STATES PATENT AND TRADEMARK OFFICE

CERTIFICATE OF CORRECTION

PATENT NO. : 5,106,660

DATED : 04-21-92

INVENTOR(S) : Mark S. Vorel

It is certified that error appears in the above-identified patent and that said Letters Patent is hereby corrected as shown below:

Column 3, Claim 1, line 23, after "edge of" insert --the panel, such that gas pumped through the manifold at a--.

Signed and Sealed this

Tenth Day of August, 1993

*Attest:*

Michael K. Kirk

MICHAEL K. KIRK

*Attesting Officer*

*Acting Commissioner of Patents and Trademarks*